US006036499A

United States Patent [19]

Ford

[11] Patent Number: 6,036,499

[45] Date of Patent: Mar. 14, 2000

[54] ELECTRICAL CONNECTOR FOR A CABLE REEL

[75] Inventor: Richard Ford, Collingwood, Canada

[73] Assignee: Walker Downriggers, Inc., Canada

[21] Appl. No.: 09/102,233

[22] Filed: Jun. 22, 1998

[51] Int. Cl.[7] ..... H01R 39/00

[52] U.S. Cl. ..... 439/4

[58] Field of Search ..... 439/4, 20; 174/128.1, 174/128.2, 102 R

[56] References Cited

U.S. PATENT DOCUMENTS

| | | | |
|---|---|---|---|
| Re. 34,693 | 8/1994 | Plocek et al. | 439/15 |
| 1,288,511 | 12/1918 | Clarke | 439/4 |
| 1,387,347 | 8/1921 | Bullis | 439/4 |
| 2,629,027 | 2/1953 | Piatt | 439/4 |
| 2,669,483 | 2/1954 | Fletcher | 439/4 |
| 3,895,883 | 7/1975 | Pedersen | 416/61 |
| 3,916,555 | 11/1975 | Booth et al. | 43/27.4 |
| 4,062,608 | 12/1977 | Pierce | 439/4 |
| 5,171,941 | 12/1992 | Shimizu et al. | 174/128.1 |
| 5,198,621 | 3/1993 | Kojima | 174/128.1 |

*Primary Examiner*—Neil Abrams
*Assistant Examiner*—Hae Moon Hyeon
*Attorney, Agent, or Firm*—Olson & Hierl, Ltd.

[57] ABSTRACT

A coupling system suitable for use with a transmission cable is described. The system includes a contact unit operably connected to a reel assembly having a base and a reel rotatably mounted to the base for winding the transmission cable. The contact unit provides for the transmission of electrical signals and power between the cable and a vessel as the cable is wound onto the reel.

16 Claims, 13 Drawing Sheets

ELECTRICAL CONNECTOR FOR A CABLE REEL

FIELD OF THE INVENTION

The present invention relates to electrical connectors, and in particular to a rotational coupling system for transmission of electrical signals and power between a rotatable cable reel and a vessel.

BACKGROUND OF THE INVENTION

A downrigger is a fishing implement used in conjunction with a regular fishing rod when deep water fishing on the Great Lakes and the oceans. The typical downrigger has a line wound on a manually or electrically operated reel. A heavy weight is placed at the end of the downrigger line which extends from the reel. Further, the downrigger line is detachably fastened to a fishing line having a fish hook with bait or a lure affixed to it.

Both the downrigger line and the fishing line are lowered into the water to a desired depth. When a fish is hooked, the fishing line is separated from the downrigger line as a consequence of the fish pulling on the fish hook to free itself, by causing the fishing line to pull out of a line release device which is attached to the heavy weight. The fisherman may then play the fish without having the downrigger weight to contend with along with the fish.

As is well known, many species of fish prefer known temperatures. Areas providing such temperatures can be quite deep, especially in the Great Lakes or oceans. Correspondingly, when fishing at such depths, the fisherman cannot see fish approach and strike the lure.

When fishing, it is desirable to have the ability to view the fish. Besides adding excitement to the fishing experience, viewing the fish provides a record in case the fish escapes.

Care must be taken, however, in providing a downrigger line and a device suitable for transmitting real-time images about the lure. In particular, the line must be of a relatively small diameter to fit on a compact trolling reel and not to cause excess drag in the water. Further, the tensile strength must be relatively high since significant tension forces are placed on the line when it is payed out a significant distance with a heavy weight attached and especially if the line becomes snagged.

Moreover, a suitable connector for retaining the connection between the camera and the electrical conductors provided by the line is desired. The connector should provide strain relief between the line and the camera to prolong the life of the line. Furthermore, the connector should transfer any pulling forces to the camera without applying these forces to the electrical conductors.

It is also desirable to provide a coupling scheme to provide power and receipt of image signals from the camera as quickly as possible whenever the depth of the camera is changed by winding or unspooling the line from the reel.

Correspondingly, the present invention provides a system which satisfies the above-discussed criteria while providing continuous electrical continuity between the camera and the vessel.

SUMMARY OF THE INVENTION

The present invention provides a coupling system for a cable used to power and tow an electrical signal transmission device and convey the electrical signals therefrom.

The structure embodying the present invention is especially suitable for use with deep water fishing. The invention provides a plurality of electrically conductive paths between an underwater camera and the boat. The connectivity of the paths are maintained while the depth of the camera is changed.

The rotational coupling system embodying the present invention includes a rotary contact unit having a rotor, secured to a reel, and a pick-up means. Disposed concentrically on the rotor are a plurality of conductive rings operably connected to a camera cable. The pick-up means is fixed relative to the vessel and has a plurality of contacts that are in electrical contact with the rings to provide for transmission of electrical signals and power between the camera and the vessel.

BRIEF DESCRIPTION OF THE DRAWINGS

In the accompanying drawings that form part of the specification, and in which like numerals are employed to designate like parts throughout the same.

DESCRIPTION OF THE PREFERRED EMBODIMENT

A rotational coupling system embodying the present invention includes a rotary contact unit with a rotor and a pick-up means. The rotor is attached to the reel of a downrigger and a plurality of conducting rings are disposed concentrically thereon. The rings are connected to electrical leads within the downrigger cable and are in communication with the pick-up means which is positionally fixed relative to the vessel. Accordingly, the pick-up means provides for the transmission of electrical signals and power between the cable and the vessel.

Figure 1:
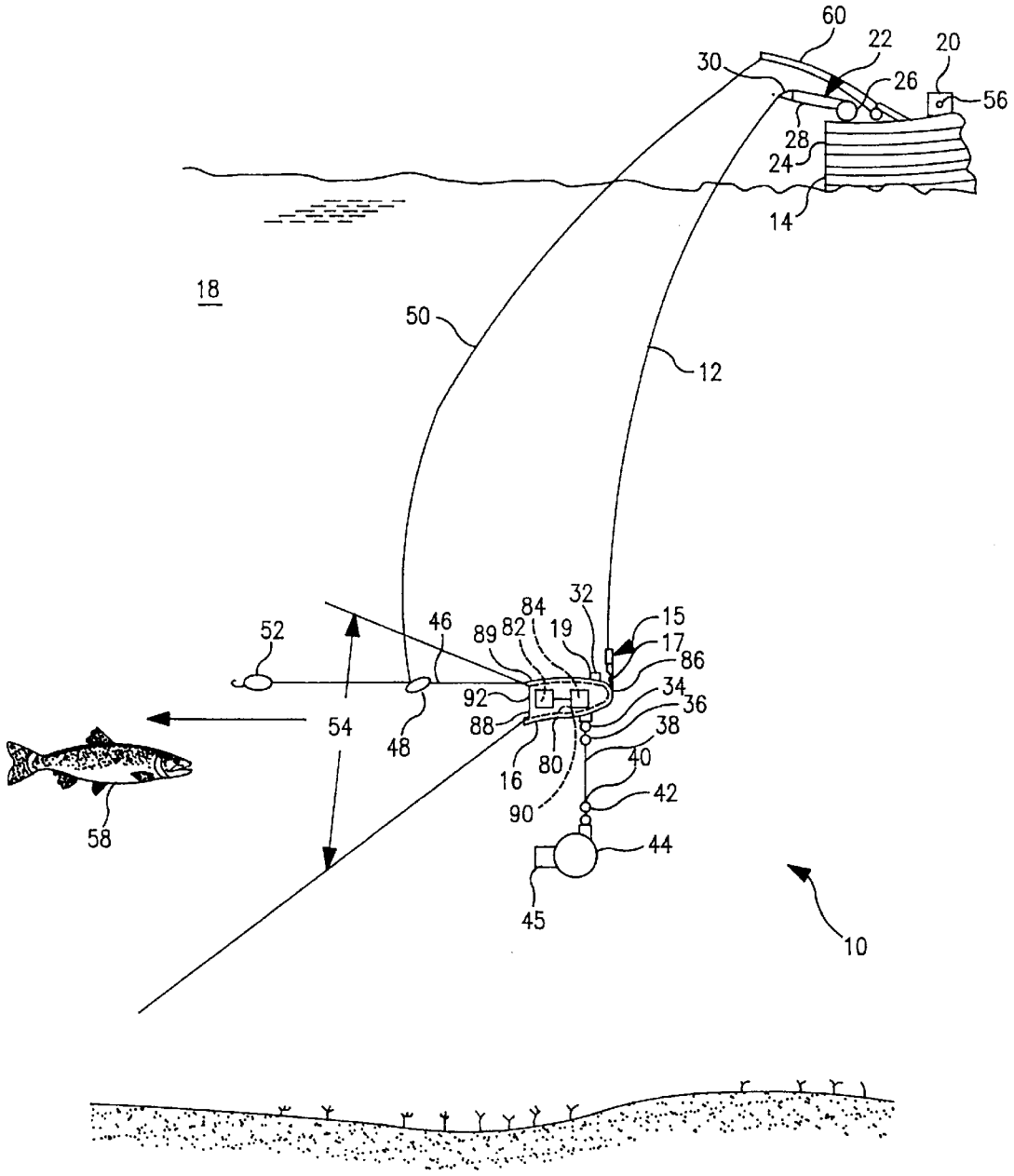
FIG. 1 is a schematic cross-sectional elevational of a body of water and illustrating the operation of an underwater viewing system with a coupling system in accordance with the present invention maintaining electrical continuity between a cable attached to a motorized reel assembly and a vessel.

Referring to the drawings, and particularly to FIG. 1, an underwater viewing system 10 is depicted having a cable 12 extending from a fishing boat 14 and terminating at a connector 15 beneath the surface of the water 18. The connector 15 is attached to a camera assembly 16 that provides for transmitting images of objects about lure 52.

Accordingly, the cable 12 provides for real-time transmission of image signals from the camera assembly 16 to the boat 14. Operably connected to the cable 12 is a display 20 on the boat 14 for visually presenting those images introduced within the camera assembly's field of view.

The connector 15 provides a conventional snap swivel 17 for coupling the connector to the camera 16. The connector 15 also includes a plug 19 for electrically coupling the cable 12 to the camera 16.

The cable 12 is attached to a motorized reel assembly 22 mounted on the stern 24 of the boat 14. The reel assembly 22 includes a reel 26 and a flexible action arm 28 generally upwardly sloping away from the reel with a guide wheel 30 rotatably mounted to the end thereof.

The cable 12 is attached to and wrapped around reel 26. The cable 12 extends from the reel 26, over the guide wheel 30 and the edge of the boat 14, and into the water 18. The motorized reel assembly 22 provides for electrically raising and lowering the cable 12 having the underwater camera assembly 16 attached proximate to the cable's free end 32.

Coupled to the camera assembly 16, via a conventional ball bearing swivel 34, is one end 36 of a safety breakaway cable 38. The other end 40 of the safety cable 38 is fastened to a snap swivel 42 that provides for releasible attachment to a relatively heavy metal weight 44.

The weight 44 may vary from, for example, one pound to thirty pounds. The particular weight a fisherman will use depends upon the type of fishing which he is doing, the depth at which he is fishing, whether or not he is trolling or standing still, the presence of currents in the water in which he is fishing and the like.

The weight 44 is conventional in shape and also preferably provides for stability, such as preventing porpoiseing of the camera assembly 16, while traveling through the water 18. Correspondingly, the weight 44 may be shaped generally like a fish, a pancake, a cannonball having a vertical stabilizer or fin 45, or any other suitable shape.

Preferably, the cable 12 has a greater tensile strength than the safety breakaway cable 38. Thus, if the weight 44 becomes snagged during trolling, the safety cable 38 will sever so that the cable 12 and reel assembly 22 are prevented from being damaged. The breakaway cable 38 consists of any suitable material such as nylon, steel, or the like.

Extending from the camera assembly 16 is a cord 46 with a conventional release mechanism 48 attached to the free end of the cord. Mechanism 48 releasably holds onto fishing line 50 having a fishhook or lure 52 tied to the fishing line's free end. Preferably, while line 50 is attached to the release mechanism 48, the lure 52 is continuously in the viewing range 54 of the camera assembly 16 such that, as explained in detail further herein, a substantially representative image 56 of the lure is provided on display 20.

When a fish 58 strikes the lure 52, the efforts of the fish to free itself results in fishing line 50 being released by mechanism 48. Thus, the fisherman is permitted to play the fish in the usual fashion by means of a fishing rod 60 to which the fishing line 50 is secured.

FIG. 1 illustrates an advantage of using the underwater viewing system 10 because, as will be discussed in further detail, the fisherman can actively view an image 56 of the fish on the display 20 as the fish approaches and strikes the lure 52. Thus, the fisherman is alerted before the fish strikes the lure and is shown the size and type of fish as well.

Figure 2:
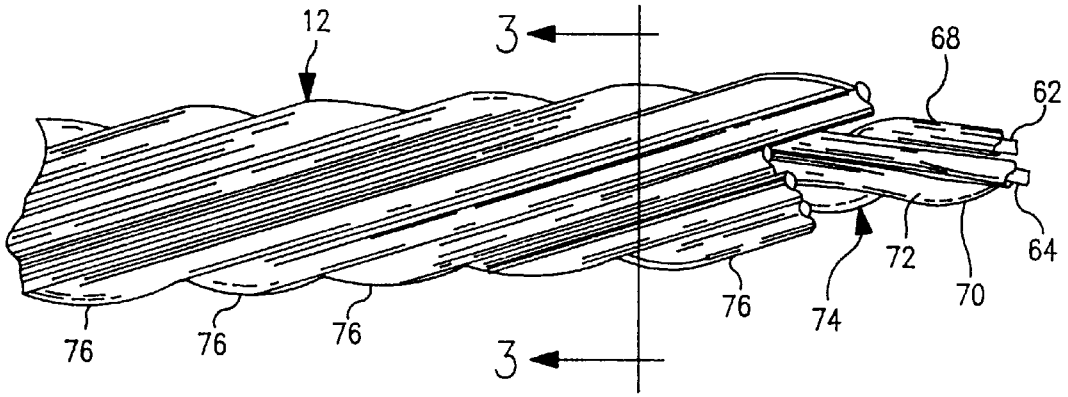
FIG. 2 is a greatly enlarged fragmentary view of the cable shown in FIG. 1.
Figure 3:
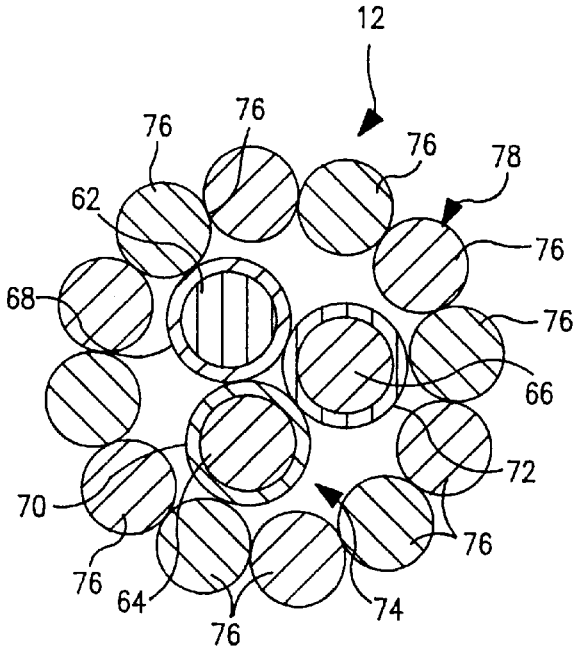
FIG. 3 is a cross-sectional view of the cable of FIG. 2, taken along section plane 3—3.

Referring now to FIGS. 2 and 3, the cable 12 employed in the underwater viewing system 10 of FIG. 1 is described in greater detail. The cable 12 preferably comprises three conductive leads 62, 64, and 66. Individually surrounding each electrical lead 62, 64, and 66 is an annular longitudinally extending electrically insulating layer 68, 70, and 72, respectively. The insulated conductive leads 62, 64, and 66 are spirally wound around each other to form a helix arrangement 74 wherein the leads preferably twist approximately three (3) times around each other per four (4) centimeters of cable length.

It is desired that each electrical lead 62, 64, and 66 be Brown & Sharpe Wire Gage No. 26 (i.e. a diameter of about 0.4 millimeters) and made of a suitable conductive material such as copper. Further, the electrically insulating layers 68, 70, and 72 comprise, in the preferred embodiment, a fluorocarbon polymer layer.

Spirally wound around the helix configuration 74 of insulated electrical leads 62, 64, and 66 are bare stainless steel strands 76. Preferably, there are twelve (12) outer strands 76 with each strand having an outer diameter of approximately 0.01 inch.

A conventional cable forming process is employed to tightly spiral wind the outer stainless steel strands 76 around the center conductors 62, 64, and 66 to form the relatively small diameter trolling wire 12 (i.e., less than 0.07 inch in diameter) while having the desired strength and durability. Preferably, the strands 76 are spirally wound in the opposite direction as that of the electrical leads 62, 64, and 66. The strands 76 adjoin against each other to form a protective sheath that envelopes the leads 62, 64, and 66. Desirably, the strands 76 are wound around the helix arrangement 74 approximately three (3) times for each four (4) centimeters of cable length. Further, the overall outer diameter of the resultant cable 12 is about 0.06 inch with a tensile strength of at least three hundred fifty pounds (350 lbs).

Referring to FIGS. 1 and 4–6, the connector 15 preferably includes a connector housing 21 and a cinch 23 that coacts with a frictional lock or tongue 25. The connector housing 21 is generally cylindrical with a planar cable receiving end 27 and an opposite cinch receiving end 29. The connector housing 21 is preferably of unitary construction, having a cross-sectional diameter of about 1.9 centimeters, and made of a commercially available black acetal resin such as that available under the designation DELRIN, a homopolymer of formaldehyde.

A channel 31 extends across the circular diameter of connector end 29 to define a pair of shoulders 33,35 that are spaced from each other. The shoulders 33 and 35 have inner planar walls 37 and 39, respectively, that are generally parallel and face towards each other. Further, the walls 37,39 project substantially perpendicular from a planar abutment 41 provided by the connector housing 21 and extending between the shoulders 33 and 35.

Longitudinally extending through the connector housing 21 is an open cylindrical bore 43 having an inner diameter that is larger than the outer diameter of cable 12. The open ends of bore 43 are located at the ends 27,29 of the connector housing 21 with opening 47 positioned between shoulders 33 and 35. Preferably, bore 43 is in spaced parallel relationship to the longitudinal axis of the connector housing 21.

Another open bore 49 extends within the connector housing 21 having a cable receiving portion 51 and an offset portion 53 in fluid communication with each other. Preferably, the cable receiving portion 51 is in longitudinal axial alignment with the longitudinal axis of the connector housing 21 and includes an open end 55 positioned between shoulders 33 and 35. Further, the offset portion 53 converges toward connector housing end 27 with an open end 57 proximate thereto.

The open end 55 is preferably located in spaced relationship between the inner walls 37 and 39 of shoulders 33 and 35, respectively. Further, open end 57 is provided on the outer cylindrical surface of the connector housing 21.

Received within channel 31 of connector housing 21 is cinch 23 preferably of unitary construction made of a plastic material such as a polyester resin, e.g. a polyethylene terephthalate (PET), or the like. The cinch 23 includes two symmetrical planar plates 59,61 in spaced parallel relationship to each other and providing a slot 63 therebetween. Each plate 59,61 generally resembles a fin with a planer proximal end 65 and an opposite rounded or blunted distal end 67. Further, each plate 59,61 has a generally straight front edge surface 69 extending between ends 65 and 67. Conversely, an outwardly angled back edge surface 71 extends opposite the front edge surface 69 and having an straight inner portion 73 angularly offset from an outer portion 75. Further, the inner portion 73 extends from the cinch proximal end 65 and, preferably, has a shorter length than the outer portion 75.

Interconnected between the plates 69,61 are two diverging side walls 77,79 extending from the proximal end 65 of the cinch 23. The walls 77,79 extend proximate to the front edge 69 and back edge 71, respectively, of plates 59 and 61. The length of wall 79 is longer than the length of wall 77 with wall 79 extending from the proximal end 65 of the cinch 23 to the outer portion 75 of the back edge 71.

The walls 77 and 79 have inner surfaces 81 and 83, respectively, that are substantially perpendicular to the plates 59,61. The wall inner surfaces 81,83 diverge from each other as they extend from the cinch proximal end 65. The wall surfaces 81,83 can be, for example, planer or grooved to match a groove on the outer periphery of the cinch 23.

The walls 77,79 also have co-planar end surfaces 85 proximate to end 65 of the cinch 23 and opposite end surfaces 87. Further, the opposite end surface 87 of wall 79 is curved inwardly to provide an arcuate outer surface.

The walls 77,79 together with the plates 59,61 define a chamber 91 adapted for receiving tongue 25 therebetween. The chamber 91 has a narrow opening 93 at the proximal end 65 of the cinch 23 and an opposite wide opening 95 between the wall ends 87 and the plates 59,61.

The cinch 23 is secured to the connector housing 21 by two screws 97. The cinch 23 is positioned between the two shoulders 33,35 of the connector housing 21. As such, the proximal end 65 of the cinch 23 abuts against the planar end surface 41 of the connector housing 21. Further, the outer surface of the cinch plates 59 and 61 abut against the inner surface 37 and 39, respectively, of the shoulders 33,35.

When the cinch 23 is affixed to the connector housing 21, both connector bores 43 and 49 are in fluid communication with the cinch chamber 91. Moreover, the back edge surface 71 of the cinch 23 is longitudinally aligned with opening 57 of bore 49.

The screws 97 that attach the cinch 23 to the connector housing 21 extend though apertures 99 in the connector housing that are in axial alignment with each other and the center of each shoulder planer inner wall 37,39. Accordingly, the screws 97 project perpendicular from each shoulder inner planar surface 37,39 and into thread apertures 101 in the cinch plates 59,61. However, it is desired that the screws 97 do not enter into the cinch chamber 91.

Pivotally attached proximate to the cinch distal end 67 is snap swivel 17 for removable attachment of the connector 15 to the camera assembly 16. The swivel 17 has an ring 103 that is rotationally mounted within the slot 63. As such, the ring 103 receives a rivet 105 that passes through the cinch plates 59,61 and is secured thereto.

Cable 12 passes through bore 43 in the connector housing 21 and into the cinch chamber 91. The distal end 32 of the cable passes through opening 55 and thus into bore 49. The distal end 32 of the cable is unraveled within bore 49 to separate the insulated electrical leads 62, 64, and 66 from the stainless steel strands 76.

Preferably, the distal ends of the stainless steel strands 76 are securely fastened together within a crimp sleeve 107. Further, the stainless steel strands 76 and the electrical leads 62, 64, and 66 are electrically coupled to a wiring harness 109 for transmitting signals and electrical power between the cable 12 and the camera assembly 16.

The wiring harness 109 is conventional in construction with four insulated electrical leads 111 coupled to cable leads 62, 64, 66, and strands 76. The harness leads 111 are attached to the cable leads by a solder connection and then covered by conventional heat shrinkable insulative material 113. Further, the strands 76 are connected to one harness lead 111 by a crimp connection within sleeve 107.

The harness leads 111 extend within an outer protective sleeve 115 that exits the bore 49 from aperture 57 and terminates with conventional electrical connector plug assembly 19 attached thereto. Preferably, to waterproof the electrical connections between the wires in the harness 109 and the cable 12, bore 49 is filled with a polyurethane or the like.

The connector plug 19 includes a threaded sleeve 121 and two pairs of complementary connector prongs (i.e., two male and two female). Sleeve 121 is conventional in construction and provides for securing the connector plug 19 to a receptacle on the camera housing. Likewise, the connector prongs are conventional and provide for making an electrical connection with the receptacle. In an embodiment, the connector prongs provide contacts that are electrical connected, via the harness wire 111 to the cable strands 76 and the leads 62, 64, or 66.

Figure 8:
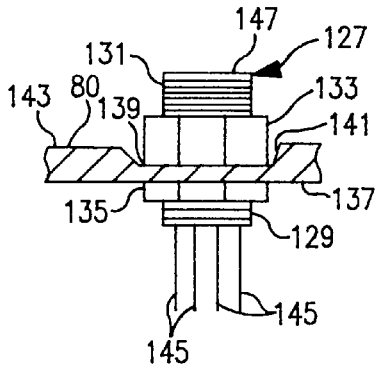
FIG. 8 is a partial cross-sectional view of a plug connector receptacle provided by the camera assembly of FIG. 1.

The plug connector 19 mates with a receptacle 127 mounted onto the camera assembly housing 80 and depicted in FIG. 8. The receptacle 127 includes a waterproof fitting 129 having a conventional electrical socket at end 147 and a threaded outer surface 131. The fitting 129 passes through a recessed or depressed area 141 in the outer surface 143 of the camera assembly housing 80 with the socket end 147 accessible from the outside.

Threaded onto the outside 131 of the fitting 129 is an outer nut 133 and a jam nut 135. Preferably, the jam nut 135 abuts against the inside surface 137 of the camera housing 80. Conversely, an o-ring 139 is sandwiched between the outer nut 133 and the outer surface 143 of the camera housing 80.

The outer nut 133 is tightened to compress the o-ring 139 surrounding the fitting 129 to form a waterproof seal between the fitting and the camera housing 80.

An electrical connection between the cable 12 and the leads 145 within the camera assembly housing 80 is formed by plugging the connector 19 into the fitting 129. Then, the threaded sleeve 121 of the connector 19 is tightened onto the threaded outer surface 131 of the fitting 129. Likewise, the electrical connector is uncoupled from the camera assembly housing 80 by removing the sleeve 121 from the fitting 129 and then pulling the connector 19 from fitting.

Figure 9:
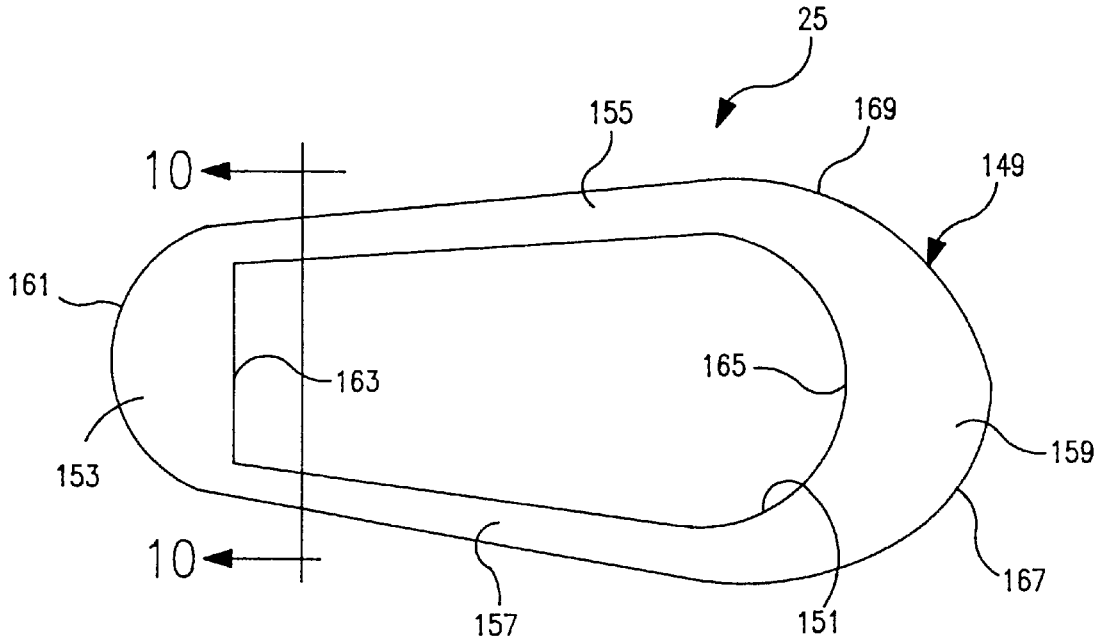
FIG. 9 is a side view of the tongue of FIG. 6.
Figure 10:
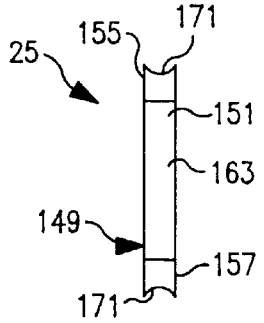
FIG. 10 is a cross-sectional view of the tongue of FIG. 9, taken along plane 10—10.

As shown in FIGS. 9 and 10, the tongue 25 has a generally cam shaped tapered body member 149 with an aperture 151 extending therethrough. The body member 149 includes an insert end portion 153, two arm members 155,157 and an outer portion 159 which together define an outer periphery for engaging cable 12.

The insert portion 153 has a generally parabolic outer surface 161 and a planar inner surface 163. The arm members 155,157 of the body member 149 extend from the insert 153 and diverge from each other. The arm members 155,157 are attached to the outer portion 159 which has generally a crescent shape with inner 165 and outer 167 arcuate surfaces. Preferably, the body member 149 has a smooth outer periphery or rim 169 with a concave groove or channel 171 for receiving a portion of the cable 12. Moreover, the body member 149 is of unitary construction and made of a polyester resin such as polyethylene terephthalate (PET).

Figure 7:
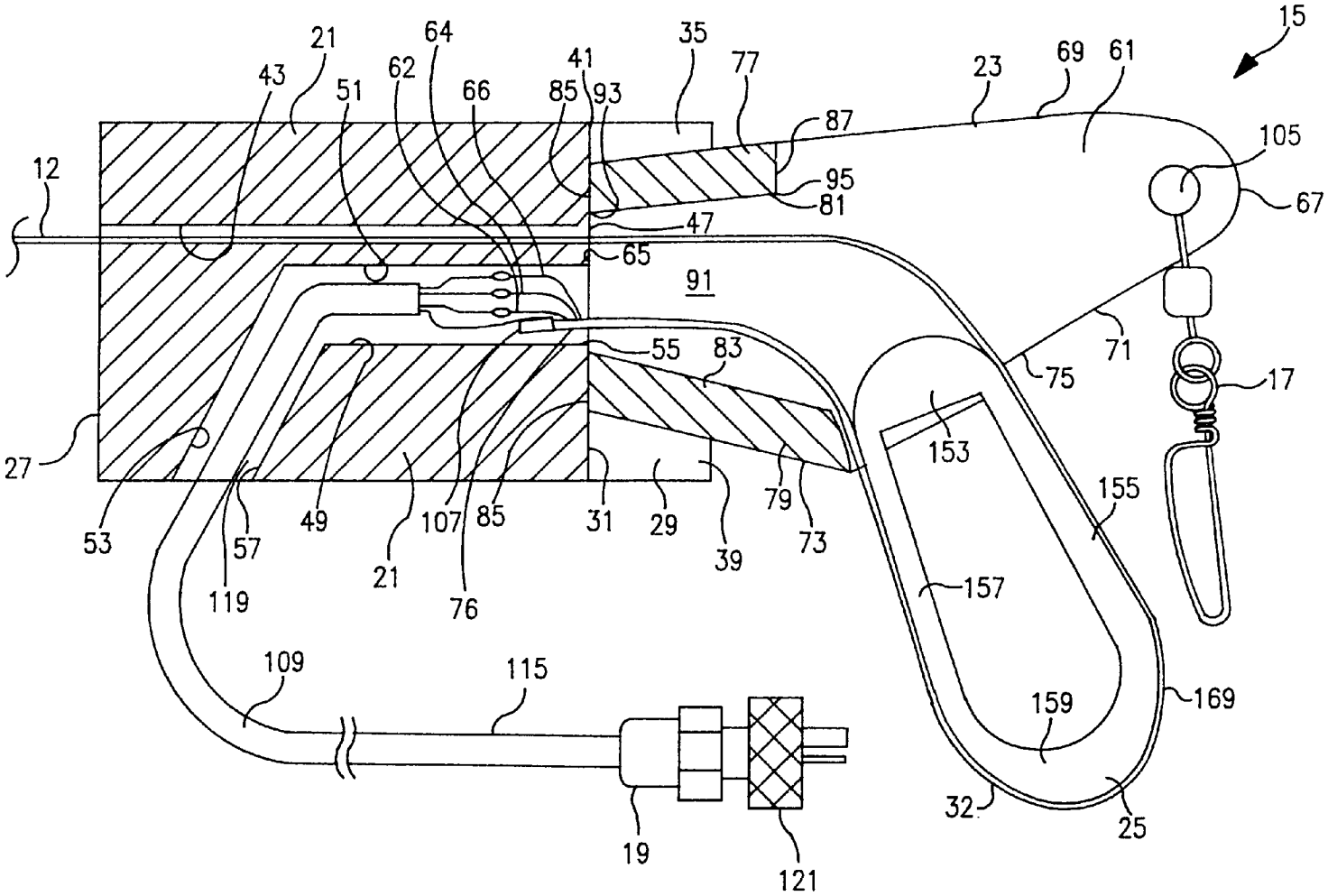
FIG. 7 is similar to FIG. 6, but with the cable loosened to allow the tongue to become disengaged.

As shown in FIG. 7, the cable 12 is looped about the outer periphery 169 of the tongue 25 defined by body member arms 155,157 and outer portion 159. By pulling the cable 12 from the first end 29 of the connector housing 21, the cable slides against the outer periphery 169 of the tongue 25 while advancing portion 153 into the cinch chamber 91. That is, in use tongue 25 is held in place by a bight in cable 12.

Figure 6:
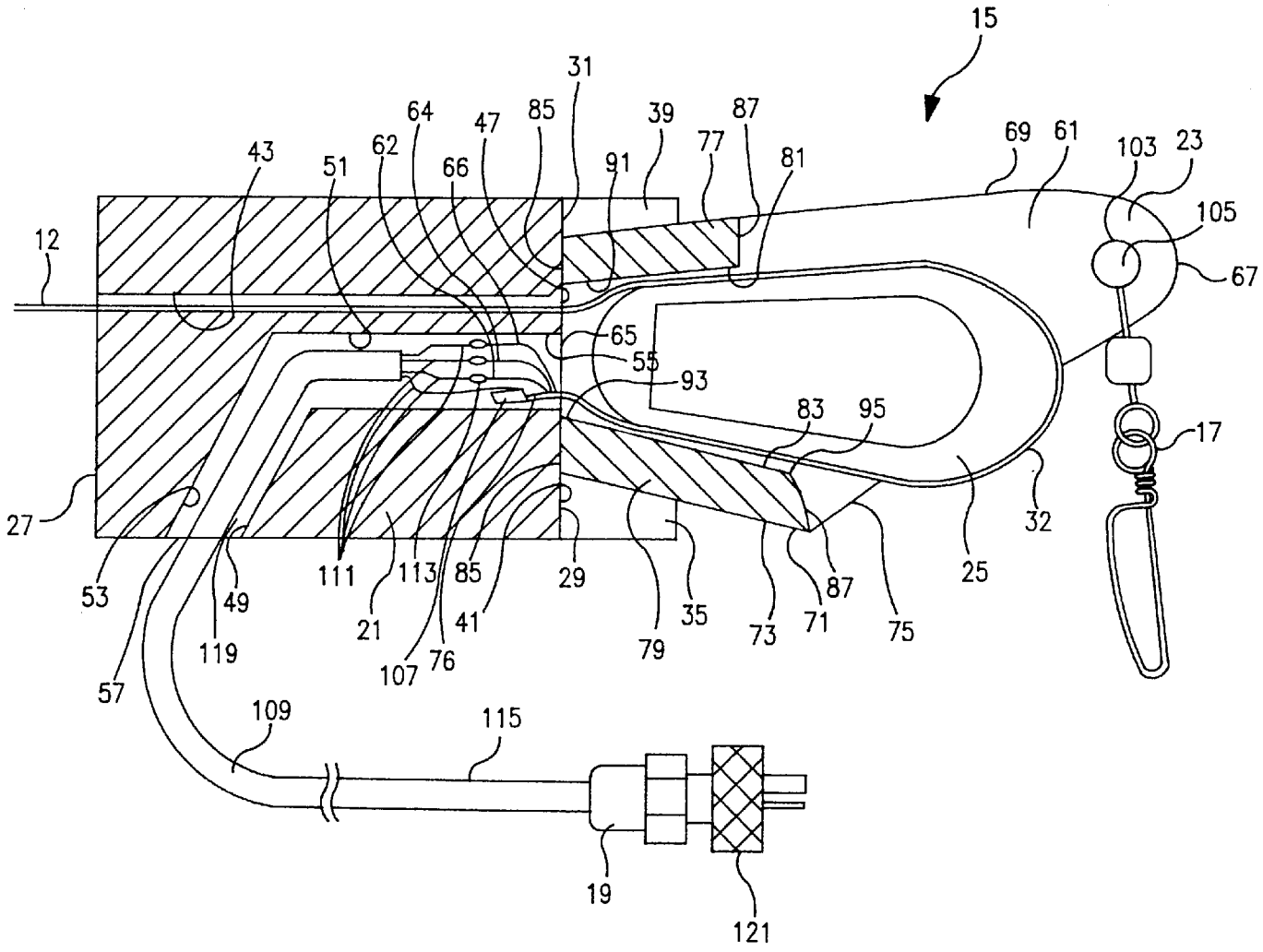
FIG. 6 is a cross-sectional view of the connector of FIG. 4, taken along plane 6—6, depicting a tongue frictionally engaging the cable within a cinch.

The pulling force on the cable 12 results in the cable becoming wedged between the tongue 25 and the inner surfaces 81,83 of the cinch walls 77,79 as shown in FIG. 6. Accordingly, the more force applied to the cable results in a like force being applied to wedge the cable between the walls 77,79 and the tongue 25.

Figure 4:
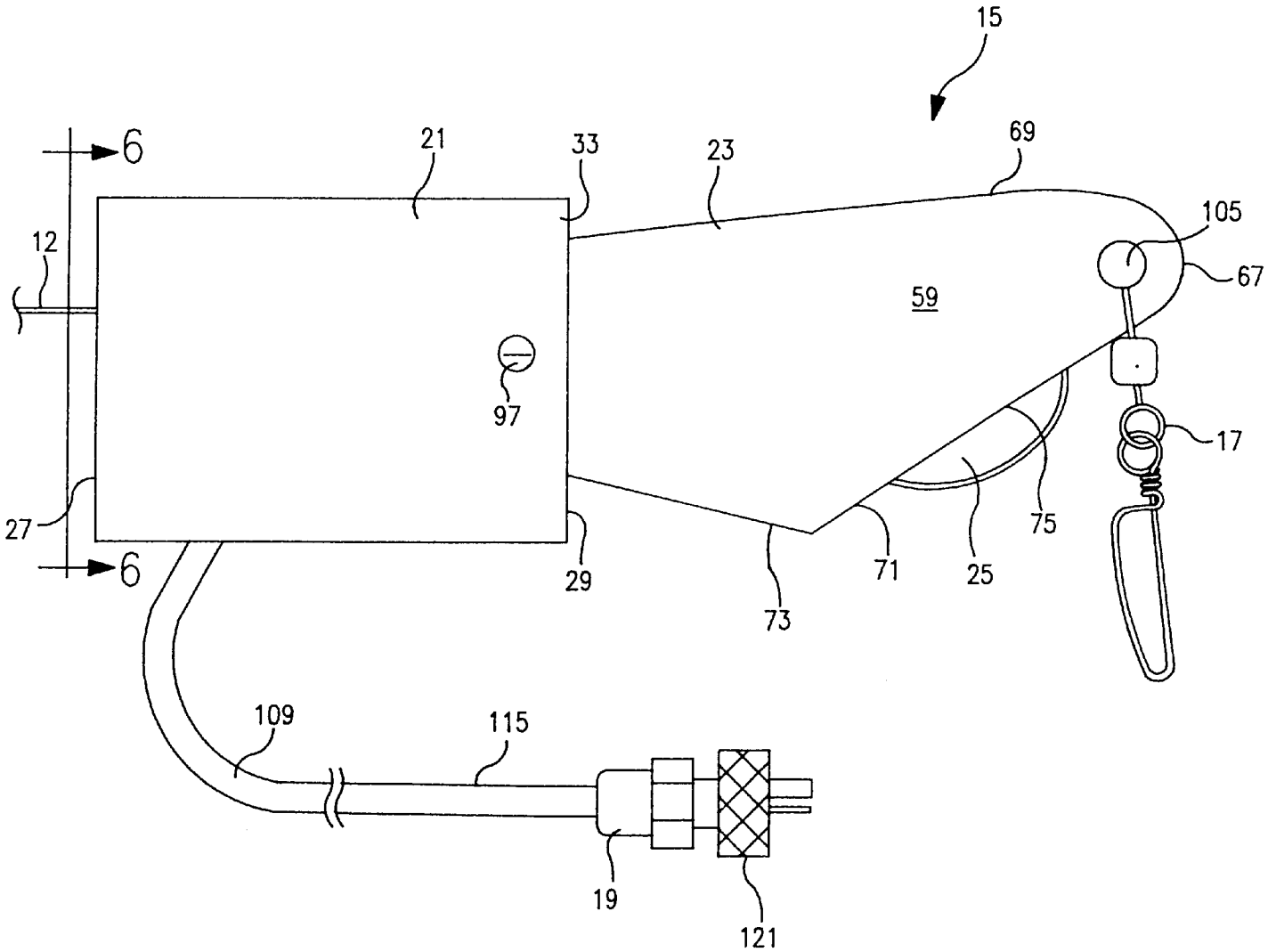
FIG. 4 is an enlarged side view of a connector coupled between a camera assembly and the cable of FIG. 1.
Figure 5:
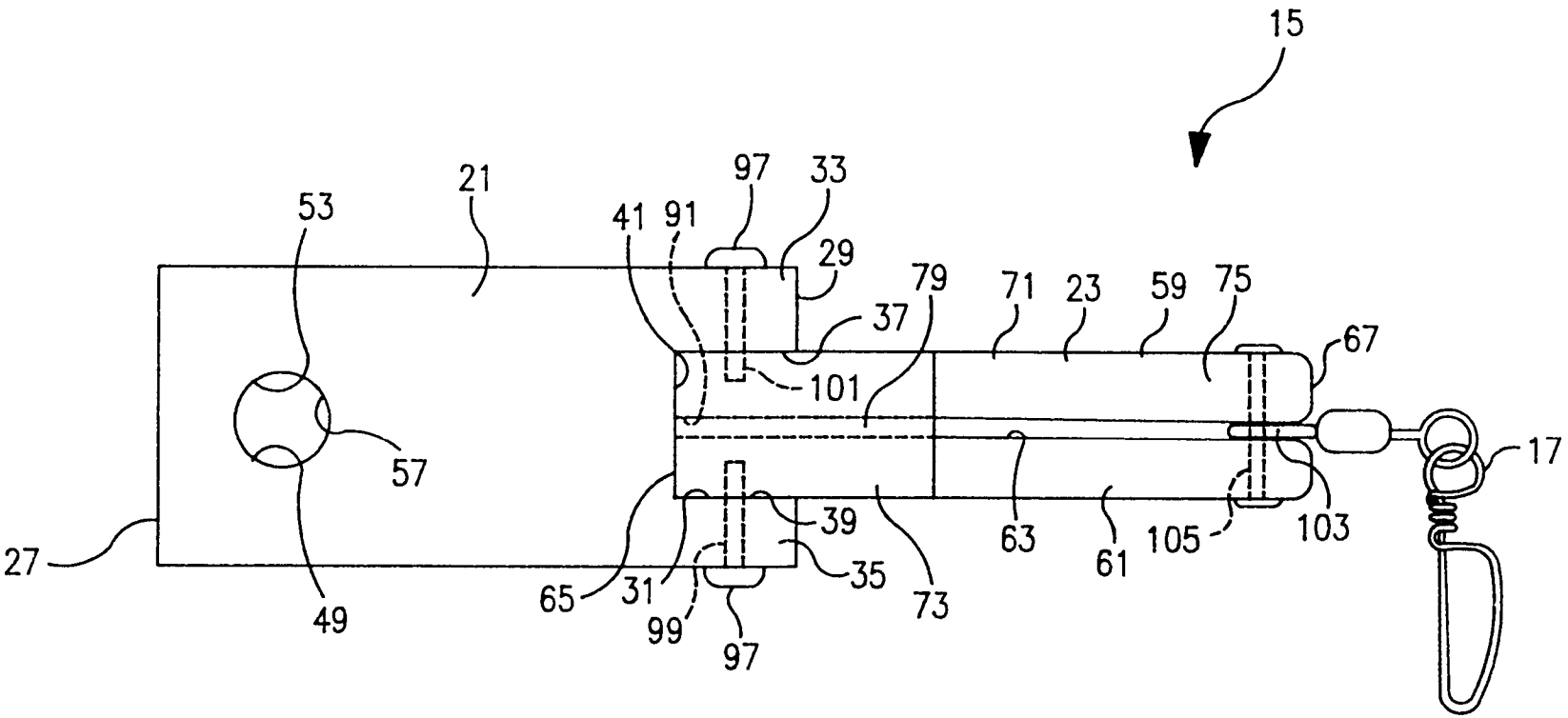
FIG. 5 is another side view of the connector of FIG. 4.

Preferably, part of the tongue outer portion 1159 outwardly projects from between the cinch plates 59,61, as shown in FIG. 4, when the cable is wedged by the tongue 25 within the cinch 23. The exposed portion can be gripped by pliers or the like to pull the tongue 25 from the cinch 23 to release the cable 12 from the cinch.

The wedging of the cable 12 between the tongue 25 and the walls 77,79 of the cinch 23 results in the cable being securely held at two different areas. Further, the holding force is distributed along part of the length of the walls 77,79 and the tongue 25.

The connector 15 is securely fastened to the camera assembly 16 by attaching the snap swivel 17 towards the front of the camera housing. Further, the plug connector 19 is attached to the receptacle 127 extending from the camera housing 80. Moreover, the wire harness 109 has a length such that, by pulling on cable 12, the pulling forces are conveyed from the cable to the camera assembly 16 by swivel 17 and not the wire harness 109. As such, pulling forces applied by trolling with boat 14 are transferred across the swivel 17 and not the leads 62, 64, and 66 within connector bore 43.

Referring back to FIG. 1, camera assembly 16 preferably includes a housing 80 with a camera 82 and lower electronics unit 84 mounted therein. The housing 80 is generally parabolic in cross-sectional shape with a blunted front end 86 and an opposite open rear end 88. The desired shape of the housing 80 results in the housing rear end 88 being substantially directed at the lure 52 as the housing travels through the water 18 during trolling. The housing 80 may be constructed of any suitable material such as plastic, metal, or a metal alloy.

To further aid in the stability of the housing 80, release cord 46 is attached to the top 89 of the housing proximate to the rear end 88. As such, during trolling, the water resistance on the fishing line 50, the lure 52, and the release 48 acts as a rudder to aid in pointing the housing rear end 88 generally towards the lure 52. In addition, to dampen yaw and the like, fins (not shown) may be added to the outside of the housing 80.

As indicated above, the housing 80 provides an open cavity 90 in communication with the housing rear end 88. Enclosing the housing rear end 88 and forming a watertight seal with the housing 80 is an optically transparent cap 92. The seal is preferably waterproof to a depth of four hundred feet (400') or greater to prevent water from entering the housing cavity 90 and damaging the camera 82 mounted therein.

Camera 82 is mounted in the housing cavity 90 adjacent to the housing end cap 92. The lens of the camera 82 is pointed generally towards the fishing lure 52 such that the lure is in the field of view 54 and focus of the camera. Thus, camera 82 provides composite video signals representative of the images introduced within the camera's field of view 54.

The camera 82 desirably is a relative low light level type. For example, tests results with a ProVideo camera Model No. CVC-50BC with a resolution of 512(H)×492(V) picture elements, EIA standard 525 TV lines (60 fields per second), and a sensitivity of 0.1 lux (F: 1.6). (CSI/SPECO, Lindenhurst, N.Y.). Preferably, the camera 82 has a focus range of approximately three (3) to twenty (20) feet and is powered by a twelve (12) volt power supply at less than about 1.2 watts.

Figure 11:
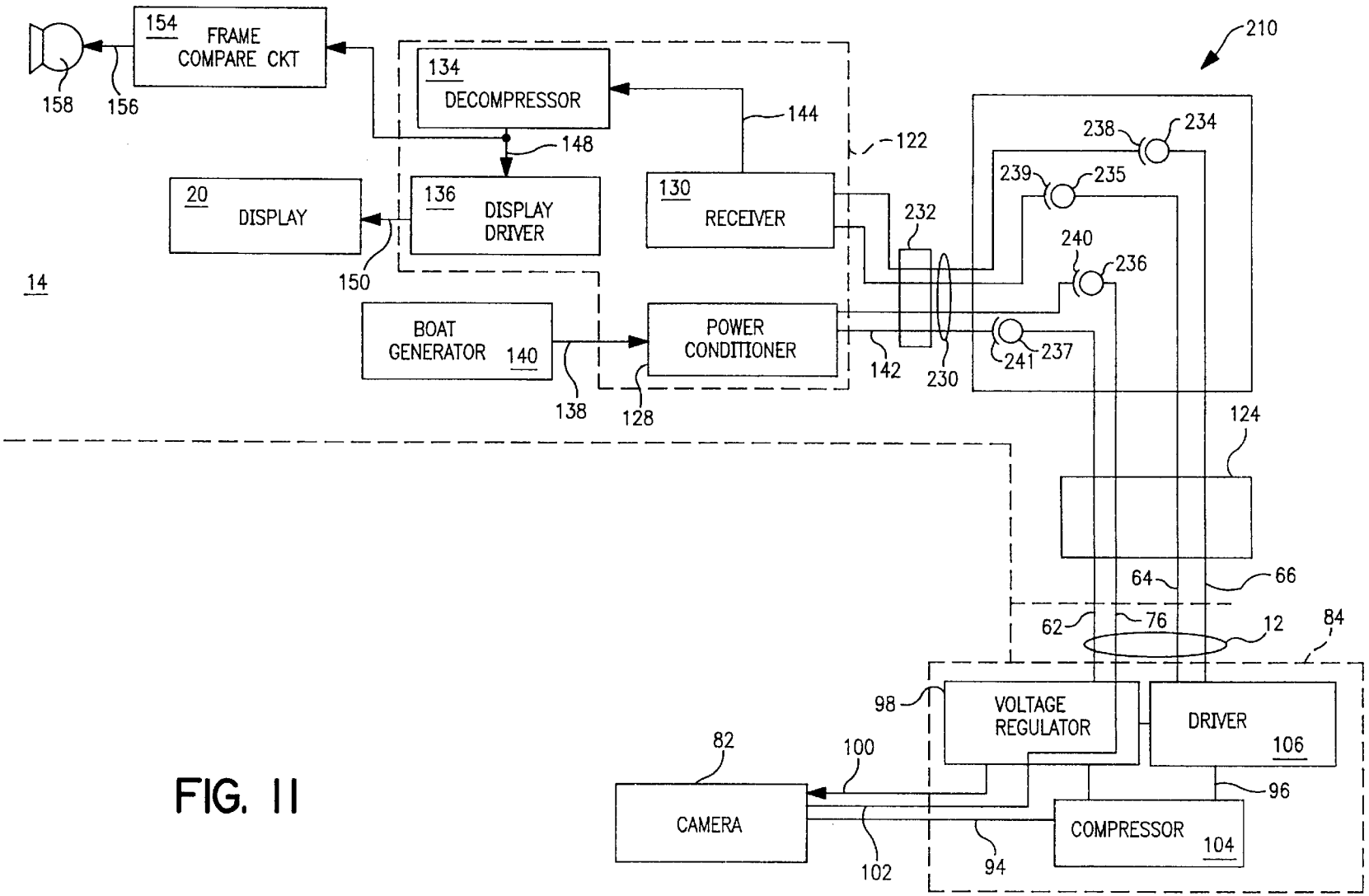
FIG. 11 is an electrical circuit diagram in block form of an embodiment of the underwater viewing system shown in FIG. 1.

The camera 82 is operably connected to the lower electronics unit 84 within the housing cavity 90. Further, as shown by FIG. 11, the lower electronics unit 84 is operably connected to conductive leads 62, 64, and 66 and at least one of the outer conductive strands 76 of cable 12. The outer strands 72 are secured to the housing 80 to pull the housing through the water during trolling.

Within FIG. 11, a single block may indicate several individual components and/or circuits which collectively perform a single function. Likewise, except for the leads 62, 64, and 66 of cable 12, a single line within FIG. 11 may represent several individual signal or energy transmission paths for performing a particular operation.

The lower electronics unit 84 provides for regulating the voltage supplied to the camera 82, compressing the composite video signals 94 generated by the camera, and driving the compressed video signals 96 from the camera assembly 16 to the boat 14.

A voltage potential is provided from the fishing boat 14, via power supply lead 62, to a voltage regulator 98 within the lower electronics unit 84. The voltage potential is regulated and conditioned by the voltage regulator 98 to supply the camera 82 with a suitable supply voltage 100. Likewise, the camera 82 is provided with a voltage return path 102 to the boat 14 via the serially connected electronics unit 84 and at least one strand 76 of cable 12.

In an embodiment wherein the cable 12 has a length of 200 feet or greater, and color or black and white composite video signals are to be transmitted from the camera to the display, the lower electronics unit 84 provides a compressor 104 for compressing the composite video signals 94 in real-time. The compressor 104 is operably connected to the camera 82 for generating compressed video signals 96 from the camera output signals 94. At cable lengths of 200 feet or greater, such video compression is desirable to reduce bandwidth or reflections that occur as the cable 12 becomes a transmission line.

The process used by the compressor 104 to condense the composite video signals 94 can be by any appropriate means known in the art to compactly represent the image data contained within the composite video signals as output signals 96. For example, the compressor 104 may operate in a similar manner as that used by ANALOG DEVICES in their ADV 601 Low Cost Multiformat Video Codec. (Analog Devices, Inc., Norwood, Mass.). Correspondingly, the output signals 96 of the compressor 104 are directly related to the input signals 94 provided by camera 82.

The compressed video signals 96 generated by compressor 104 are received by driver 106 within the lower electronics unit 84. The driver 106 converts and transmits the compressed video signals 96 to the boat 14, via cable 12, as differential signals on twisted-pair leads 64 and 66. As such, the driver 106 may include a pair of video amplifiers with high-output drive capability or other like elements suitable for converting the compressed video signals 96 into differential output signals.

Figure 12:
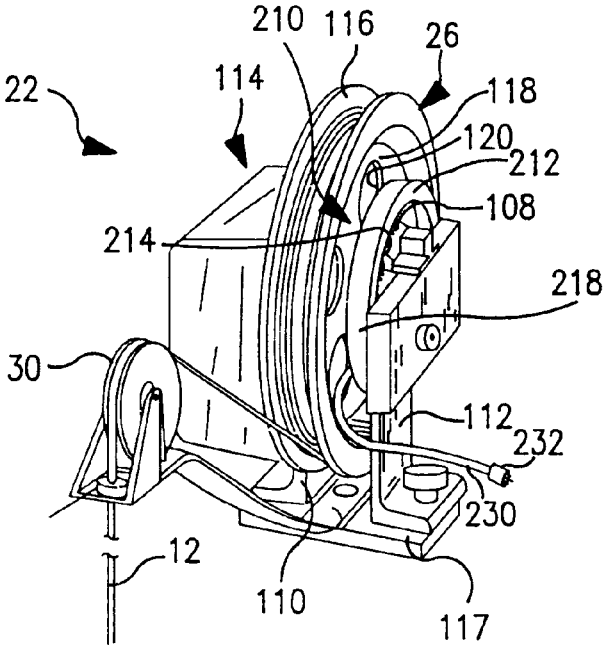
FIG. 12 is a front perspective view of the motorized reel assembly shown in FIG. 1 with a rotary contact unit attached thereto.
Figure 13:
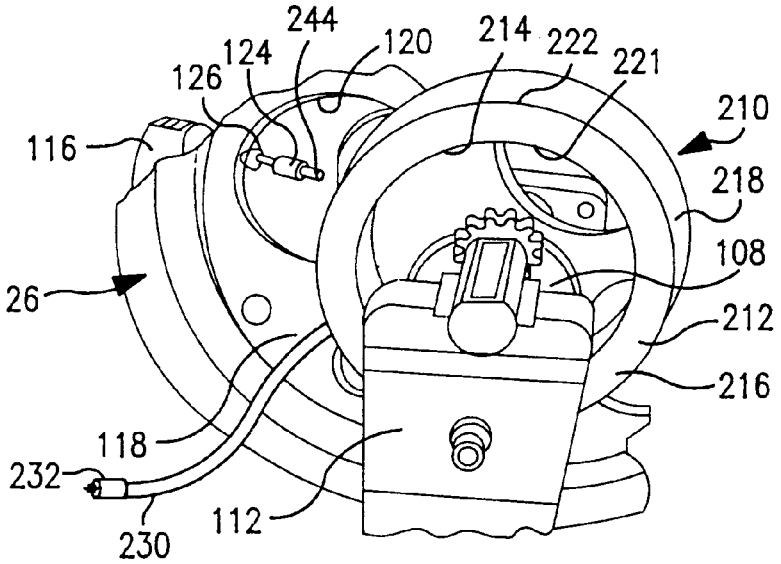
FIG. 13 is an enlarged partial perspective view of the rotary contact unit shown in FIG. 12.

Turning to FIGS. 12 and 13, cable 12 is wrapped around the reel 26 of motorized assembly 22 which is conventional in construction except for, as described in detail herein, the addition of a rotary contact unit 210 that provides a plurality of electrical transmission paths between the boat 14 and the cable 12. The motorized assembly 22 consists of, for example, the rotary contact unit 210 mounted on the device disclosed by U.S. Pat. No. 3,916,555, issued to Booth et al., and incorporated herein by reference.

The reel 26 of the motorized assembly 22 is rotatably mounted to a suitable support, for example, arm 112 which is in turn attached to a base 117 suitable for mounting onto a boat. The motorized assembly 22 includes a central spindle 108 which is secured to a reel shaft rotatably supported by means of a pair of bearings fitted into the support near the top. The shaft extends at one end into a reel drive unit 114 that includes a reversible drive motor to be rotatably driven thereby. The reel 26 can be made of any suitable material, and preferably is made of acrylonitrile-butadiene-styrene resin (ABS) with a channeled perimeter 116 for holding the cable 12. A web 118 extends between spindle 108 and channel 116 of the reel 26 and includes a plurality of spaced apertures 120.

Preferably, the rotary contact unit 210 (FIGS. 12 and 13) has a rotor 224 (FIGS. 16 and 17) which carries the electrical contact surfaces and an optional protective outer housing 212. The rotor 224 is mounted to the reel 26 and turns as the reel is turned.

The optional housing 212 is useful to protect the integrity of the relatively movable electrical connecting surfaces from contamination or corrosion such as may be caused by a saltwater spray. The housing 212 is attached to arm 112 of the motorized assembly 22 by conventional means. The housing 212 is preferably made of a rigid plastic, such as ABS or the like, and is generally annular with a center aperture 214 that allows the shaft of the motorized assembly 22 to pass therethrough.

If present, the outer housing 212 is unitary in construction and is preferably shaped to provide a base wall 216 with an outer wall 218 and an inner wall 220 extending therefrom. The base 216 is planar and has the appearance of a large washer with an inner annular perimeter 221 and an outer annular perimeter 222.

The outer wall 218 and inner wall 220 of the housing 212 extend perpendicularly from the inner perimeter 221 and the outer perimeter 222, respectively. Both walls 218,220 have an annular outer surface and, as shown in FIG. 16, extend proximate to the web 118 of the reel 26.

Figure 16:
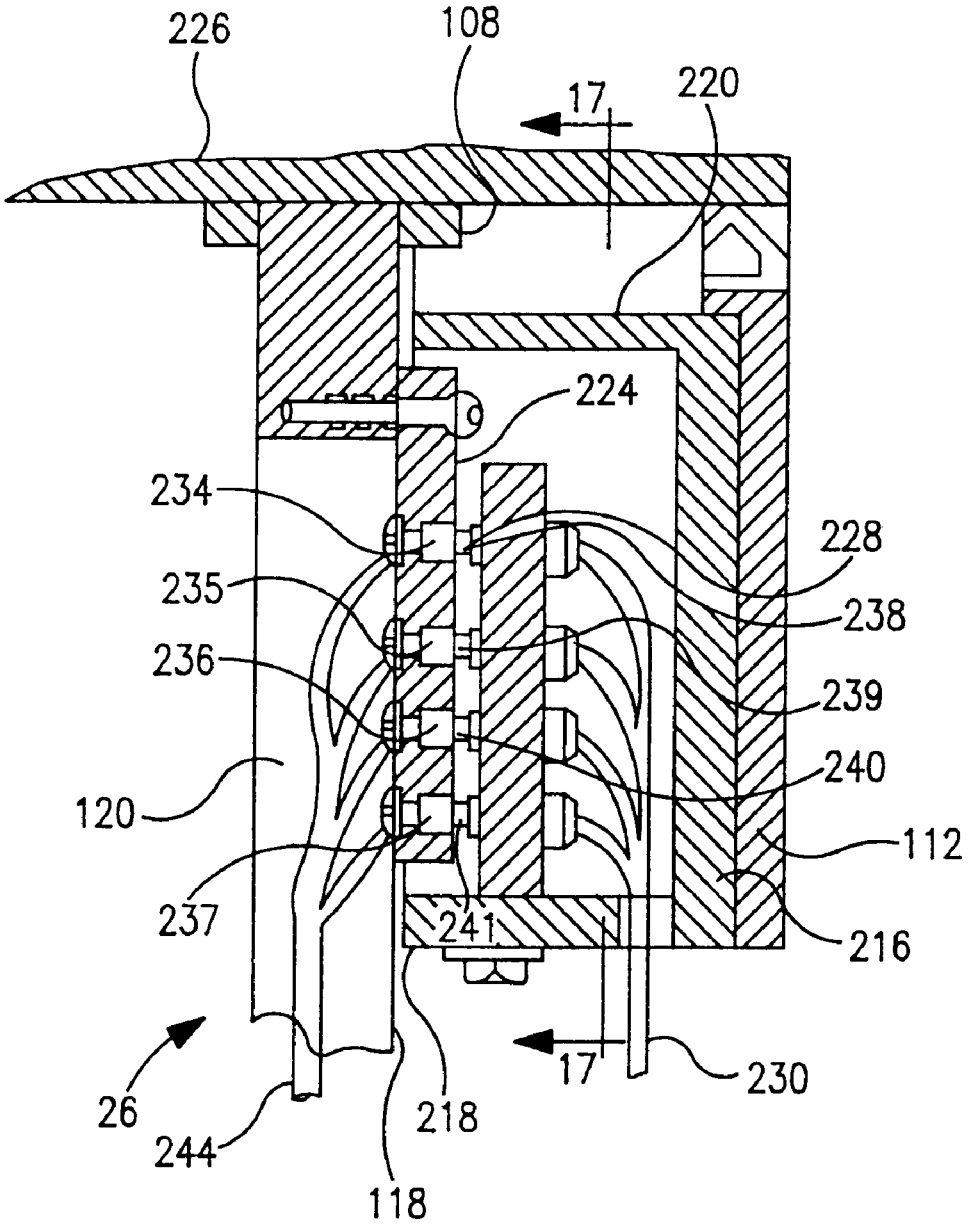
FIG. 16 is a fragmented detail section of a portion of the motorized reel assembly shown in FIG. 12.

As also can be seen in FIG. 16, the rotor 224 of the rotary contact unit 210 is secured concentrically to the web 118 of the reel 26 by conventional fasteners such as screws or the like. As such, the rotor 224 rotates with the reel 26 about the axis of motor assembly shaft 226.

The signal pick-up means 228 cooperates with the rotor 224 to receive electrical signals from the camera 82 as will be described in greater detail with reference to FIGS. 11, 16, and 17. The pick-up means 228 of the contact unit 210 is secured to the outer wall 218 of the housing 212 which is attached to arm 112 of the motor assembly 22. Consequently, the pick-up means 228 is fixed relative to the fishing boat 14.

The rotary contact unit 210 operably connects the cable 12 wound about reel 26 to an upper electronics unit 122 that is described in detail further herein. The pick-up means 228 of the contact unit 210 is coupled to the upper electronics power unit 122 via a wire bundle 230. A conventional quick disconnect connector 232 is attached to the wire bundle 230 to provide connecting means for electrically connecting the pick-up means 228 to the upper electronics unit 122. The electrical circuit associated with the camera 82, the rotary contact unit 210 and the upper electronic unit 122 is described in greater detail with reference to FIG. 11.

Preferably, as shown in FIG. 13, the cable 12 extends through the end of reel channel 116 and is anchored at one end of the reel 26 at an edge of one of the apertures 120 by a crimping clip 126 or the like. An aperture is drilled through the channel and a portion of the reel web to allow cable 12 to be so anchored. A conventional quick disconnect or reel connector 124 is coupled to the end of the cable 12 to provide connecting means for electrically connecting the cable to the rotor 224 of the rotary contact unit 210.

The rotary contact unit 210 embodying the present invention and connected as described above ensures that the electrical signal and power transmission paths between the upper electronics unit and the lower electronics unit 84 are constantly maintained.

Figure 14:
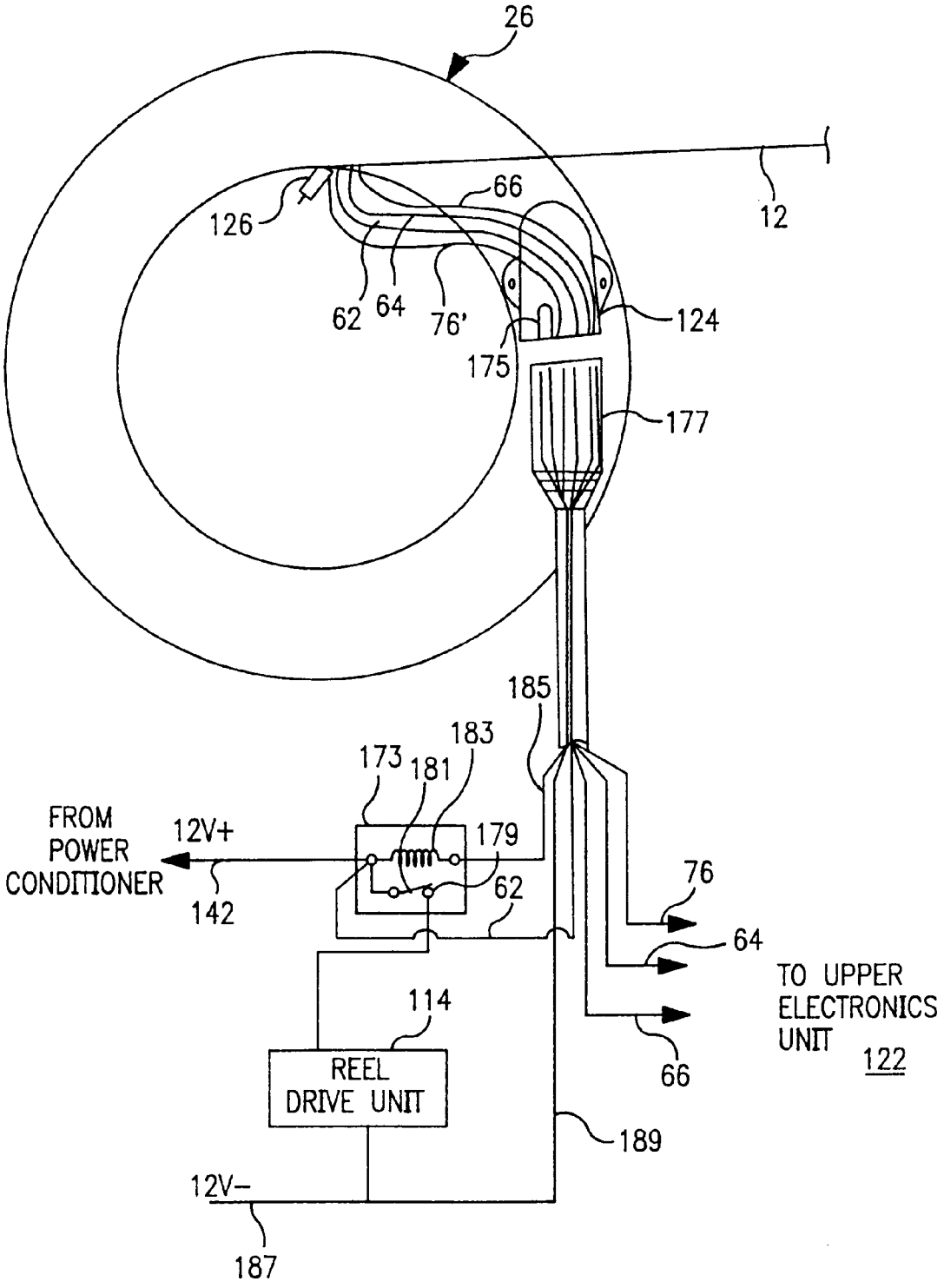
FIG. 14 is a schematic diagram of inadvertent cable uptake protection circuitry for use with another embodiment of the motorized reel assembly that does not include the rotary contact unit shown in FIG. 12.

In an embodiment, as shown in FIG. 14, the rotor contact unit is omitted and, instead, the cable 12 is connected to a connector 124 mounted on the side of the reel 26. In this embodiment, inadvertent uptake of the cable 12 while it is attached to the upper electronics unit 122 is prevented by the protection circuity of FIG. 14. This circuitry includes an interrupt relay 173 and a return current path 175 for disabling the reel drive unit 114 when plug 177 is inserted into connector 124.

Plug 177 mates with connector 124 for connecting the upper electronics unit 122 to the cable 12. As shown in FIG. 14, the connector 124 is mounted on the side of the reel 26. The cable leads 62, 64, and 66 extend within the connector 124 and the strands 76 of the cable 12 are electrical coupled to the connector by a lead 76' crimped within clip 126. Further, return current path 175 is provided within the connector 124 for toggling the interrupt relay.

The interrupt relay 173 has a contact 179, an armature 181, and a coil 183. The armature 181 and one end of the coil 183 are electrically connected to a supply voltage 142 such as, for example, 12 volts dc. The other end of the coil 183 is connected to a lead 185 extending from the plug 177.

The relay contact 179 is electrically connected to the reel drive unit 114. Preferably, the armature 181 is biased to electrically connect the contact 179, and thus the reel drive unit 114, to the supply voltage 142.

To operate, the reel drive unit 114 preferably must be connected to the supply voltage 142 and a reference voltage 187 of, for example, zero volts dc. The reference voltage 187 also is connected to a lead 189 extending to the plug 177.

When the plug 177 is removed from the connector 124, power is provided to the reel drive unit 114 for rasing and lowering the cable 12. The power is provided from the supply voltage 142, via the normally closed contacts of relay 173, and the reference voltage 187.

Conversely, when the plug 177 is attached to the connector 124, power is effectively removed from the reel drive unit 114 to prevent inadvertent uptake of the cable 12. Attaching the plug 177 to connector 124 results in lead 185 becoming coupled to lead 189 via a connection formed by both leads with the current return path 175. As such, a voltage potential is asserted across the coil 183 consisting of the difference between the supply voltage 142 and the reference voltage 187. Accordingly, energizing the coil 183 results in the armature 181 breaking the electrical connection with contact 179. Thus, the supply voltage 142 is operably disconnected from the reel drive unit 114.

Power is restored to the reel drive unit 114 by removing the plug 177 from the connector 124. This results in lead 185 being electrically disconnected from the current return path 175, and thus lead 189. Accordingly, the armature 181 reverts back to its biased state of electrically connecting the contact 179, and thus the reel drive unit 114, to the supply voltage 142.

The upper electronics unit 122 is mounted on the boat and, as shown in FIG. 11, is preferably coupled via the rotary contact unit 210 to the electrical leads 62,64,66 and at least one of the outer conductive strands 76 of cable 12. As such, the rotary contact unit 210 provides a plurality of discrete electrically conductive paths between the upper electronics unit 122 and the lower electronics unit 84.

Figure 17:
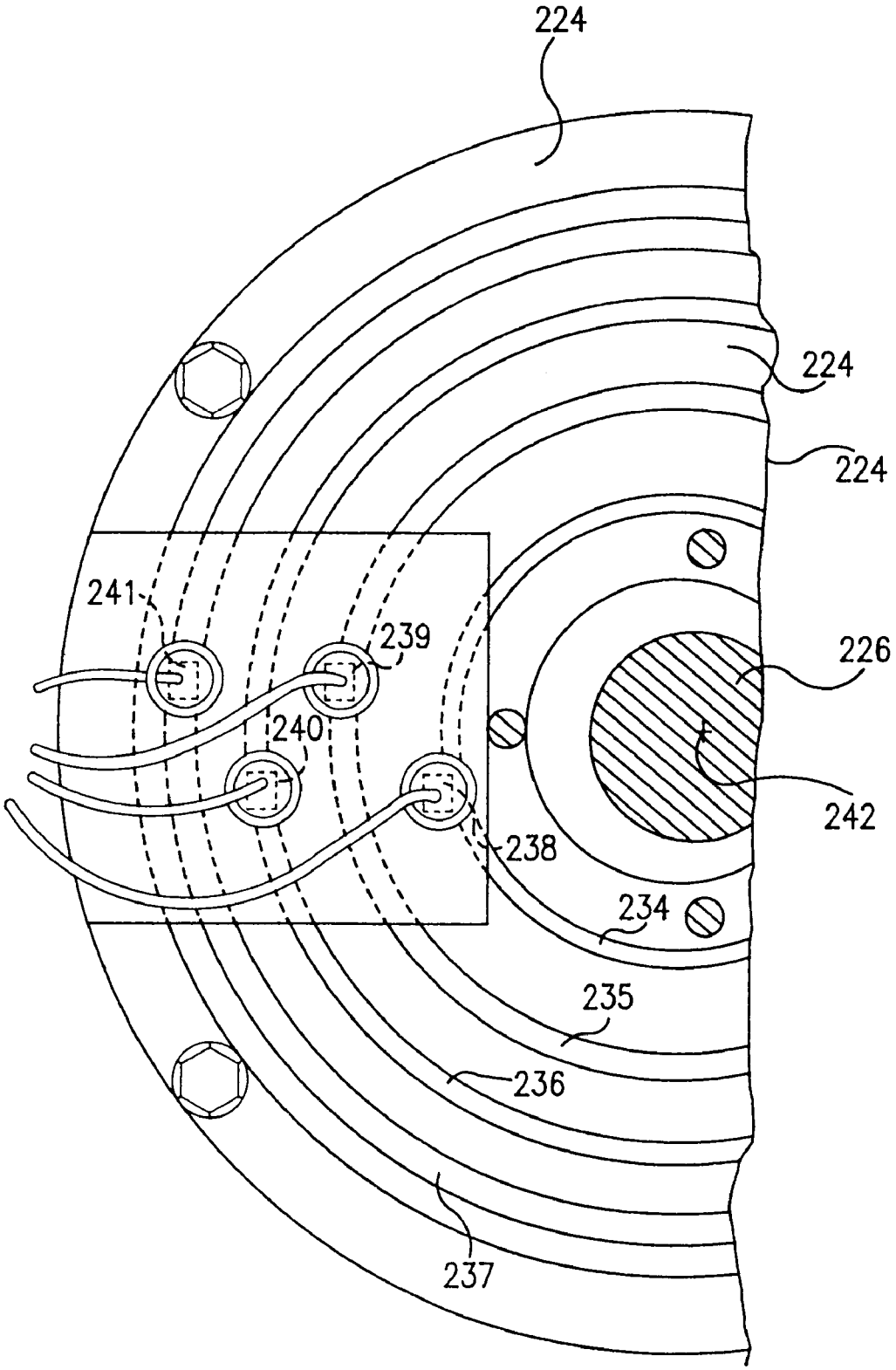
FIG. 17 is a fragmented simplified detail view as seen from plane 17—17 of FIG. 16, some portions being omitted.

With reference to FIGS. 16 and 17, the rotor 224 of the contact unit 210 is secured to the reel 26. The rotor 224 carries first, second, third, and fourth conducting rings designated 234, 235, 236, and 237, respectively, each ring being operably coupled to a respective wire within the cable 12 via a wire bundle 244. Each conducting ring is insulated from the rotor 224 and from adjacent conducting rings and is swept by a respective conducting brush, four brushes namely, first, second, third, and fourth brushes 238, 239, 240, and 241 being shown and mounted in the pick-up means 228. The conducting rings 234 through 237 are disposed concentrically relative to the motorized reel assembly shaft 226 and are surfaces of revolution centered on axis 242 of the shaft 226 and the reel 26. The rings can be disposed on a diametrically plane surface of the rotor 224 as shown, or if desired, can be on a conical or cylindrical surface, the last two alternative surfaces not being illustrated.

The depth of the camera is altered by winding or unwinding the cable about the reel. As the reel is rotated about the axis 242 of shaft 226, the rotor 210 also rotates about the axis. The position of the brushes, however, remains fixed relative to the boat 14. Each brush slides against its respective conductive ring and thus provides a continuous electrical connection between the upper electronics unit and the lower electronics unit. Accordingly, the transmission paths between the units are continuously maintained whether the depth of the camera is being changed or not.

As will be appreciated by those skilled in the art, the brushes of the pick-up means can be substituted, if desired, by resiliently biased conductive fingers, wave washers as shown in U.S. Pat. No. Re. 34,693 to Plocek et al. and incorporated herein by reference, or the like.

The conducting rings 234-237 and the pick-up means 228 can be protected from contamination by an optional housing 212 with the wire bundle 230 extending therefrom. Preferably, as stated above, another wire bundle 244 is operatively coupled to the conducting rings 234–237 and the connector 124 for conductively coupling the rings to the downrigger cable 12.

The upper electronics unit 122 provides a power conditioner 128, a receiver 130, a decompressor 134, and a display driver 136. The power conditioner 128 is coupled to an unregulated voltage source 138 provided by the boat 14 such as a marine battery or generator 140. The power conditioner 128, which is conventional in construction, regulates the boat voltage 138 to generate a conditioned supply voltage 142 that is transmitted, via lead 62, to the lower electronics unit 84.

Preferably, the power conditioner 128 converts the boat voltage 138 into a conditioned voltage 142 wherein noise generated by electromagnetic interference from other electrical systems on the boat is removed. The power conditioner 128 also is capable of providing a substantially constant voltage potential to the lower electronics unit 84 during periods where the boat supply voltage 138 is temporary interrupted or drops to a low level such as when starting the engine of the boat 14.

The typical fishing boat 14 will provide power conditioner 128 with an unregulated voltage potential 138 of about twelve (12) volts. However, because the camera 82 preferably requires a supply voltage 100 of twelve (12) volts, it is desired that the power conditioner 128 boost the supply voltage 142 to overcome the voltage drop across the cable 12. For example, if the camera 82 requires twelve (12) volts and the line drop across the cable 12 is two (2) volts, then the output of the upper electronics unit provides a conditioned supply voltage 142 of fourteen (14) volts.

In an alternative embodiment, the camera 82 may be powered by one or more batteries contained within the camera assembly 16. Thus, the upper electronics unit power conditioner 128, electrical lead 62, and lower electronics unit voltage regulator 98 would be eliminated in such an embodiment since the lower electronics unit 84 would contain its own self-sufficient voltage source.

Returning back to the embodiment shown in FIG. 11, the upper electronics unit receiver 130 receives the differential signals transmitted, via twisted-pair leads 64 and 66, by driver 106. The receiver 130 converts the differential signals into an output signal 144 preferably consisting of a single ended compressed video output. As such, the receiver 130 may include a video amplifier with a high-output-drive capability or other like elements appropriate for converting differential signals into video output signals.

The video output 144 from receiver 130 is received by the decompressor 134 which transforms the compressed signals into reconstructed composite video signals 148 in real-time. Preferably, the compressed signals 144 are transmuted by using a suitable decompression algorithm such that the composite video signals 148 are substantially similar to the camera video output signals 94.

The display driver 136 is operably connected to the decompressor 134 for receiving the composite video signals 148. The display driver 136 processes the composite video signals 148 to generate display signals 150 compatible with display 20. Preferably, the display signals 150 are provided by display driver 136 in a standard NTSC video format.

As indicated above, the output signals 150 of driver 136 are received by display 20 which provides images of the lure 52 and any fish in the camera's field of view 54. The display 20 preferably consists of a conventional black and white CRT which can be powered by a twelve (12) volt source. Alternatively, the display 20 may provide color images of the lure 52 and any fish.

The present invention may also include a frame compare circuit 154 for generating an indicator signal 156 whenever a fish approaches the lure 52. The frame compare circuit 154 is operably connected to the upper electronics unit 122 for receiving composite video signals 148 from decompressor 134. The compare circuit 154 detects changes in the video signals 148 such that, when a significant change as described below occurs, signal 156 is generated to activate a warning horn 158 or other alarm device such as a flashing indicator or the like.

Preferably, the frame compare circuit 154 filters the signal 148 such that motion of the lure 52 or gradual changes in water color will not cause activation of the alarm 158. However, sudden significant changes, such as a fish approaching the lure 52, will result in the frame compare circuit 154 sounding the alarm 158.

In operation, the fisherman lowers the weighted cable 12 and accompanying releasably attached fishing line 50 by actuating the motorized reel assembly 22 shown in FIGS. 1, 12, and 13. Once the desired depth has been reached, the reel assembly 22 is deactivated thus holding the fishing lure 52 substantially at the desired depth. With the present invention, a significant length of cable 12 can be wound on reel 26 to reach depths up to or even in excess of 200 feet where required.

Because the contact unit 210 continuously maintains the electrical connections between the cable 12 and the upper electronics unit 122, the transmission of images about the lure 52 are provided to the display 20 both while the cable is lower and is maintained at the desired depth. Accordingly, as the fisherman proceeds to troll with the camera assembly 16, real-time images of the lure 52 are provided via display 20.

The strong stainless steel outer shield 78 of the cable 12 provides for the high tensile strength required for trolling with the submerged camera assembly 16, and weight 44, which may be payed out a significant distance and become snagged. Further, the twisted pair of data leads 64,66 within the cable 12 allow for the images from the camera to be transmitted, in real-time, to the boat 14.

If the fisherman becomes distracted, the frame compare circuit 154 will activate the alarm 158 to alert the fisherman when a fish approaches the lure 52. The fish may strike the lure 52 which results in mechanism 48 releasing the fish line 50 so that the fisherman may play the fish without the fish line being attached to the downrigger.

Figure 15:
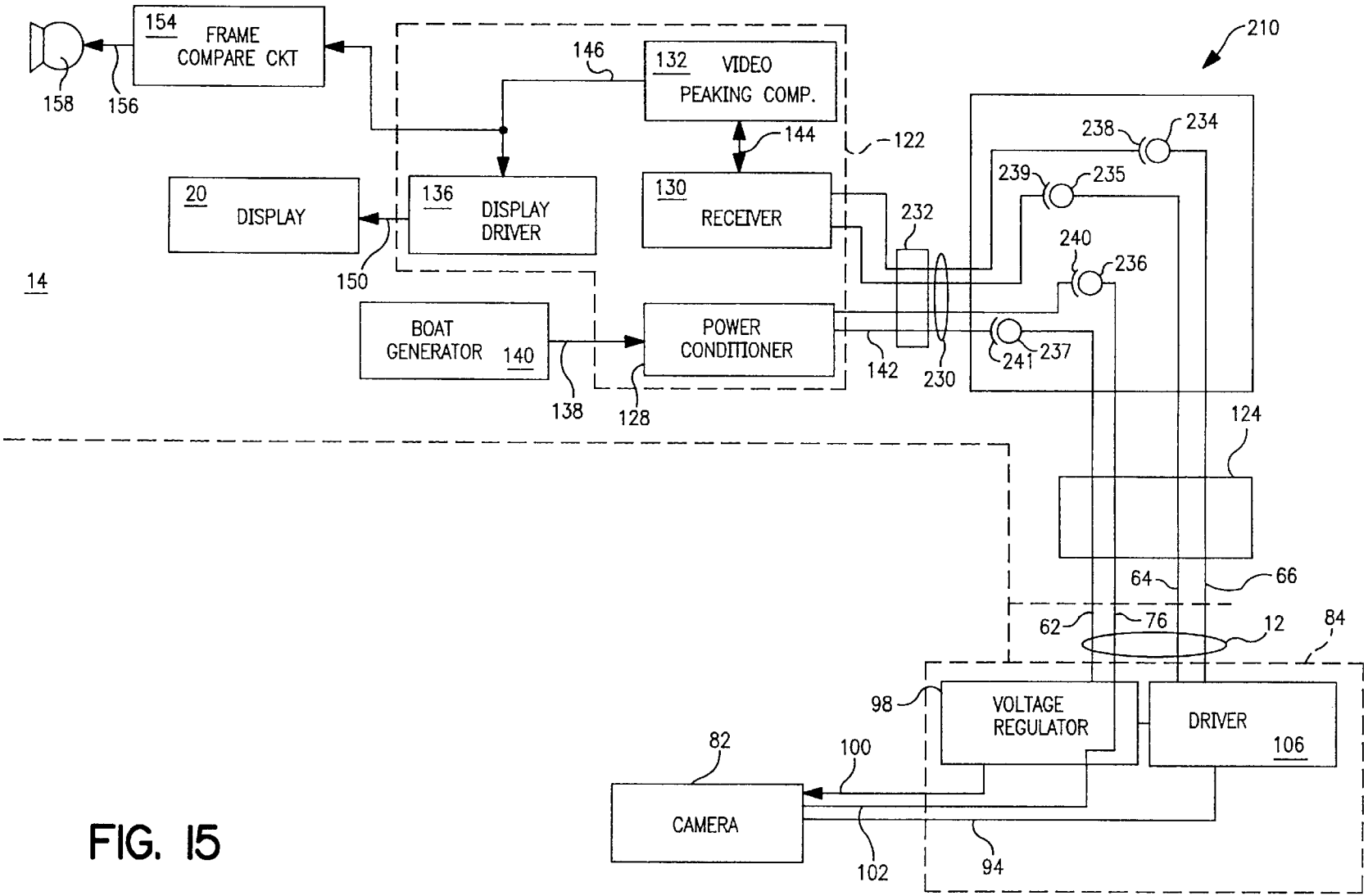
FIG. 15 is an electrical circuit diagram in block form of another embodiment of the underwater viewing system shown in FIG. 1.

Referring to FIG. 15, an electrical circuit diagram in block form is provided of another embodiment of the underwater viewing system shown in FIG. 1. The embodiment of FIG. 15 is similar to that of FIG. 11 except that the compressor has been eliminated and the decompressor has been replaced by a video peaking compensation circuit 132.

In FIG. 15, the cable 12 may have a length of 200 feet or greater and preferably is used for the transmission of black and white or color composite video signals from the camera 82 to the display 20. As such, the driver 106 is operably connected to the camera 82 to receive the black and white or color composite video signals 94. The driver 106 converts and transmits the video signals 94 to the boat 14, as differential signals, via twisted-pair leads 64 and 66.

As shown in FIG. 15, the upper electronics unit 122 is attached to the cable 12 via contact unit 210 and preferably includes power conditioner 128, receiver 130, video peaking compensation circuit 132, and display driver 136. The receiver 130 within the upper electronics unit 122 receives the differential signals conveyed on twisted-pair leads 64 and 66. The receiver 130 converts the differential signals into output signals 144 which preferably consist of a single ended video output.

The video output 144 from receiver 130 is adjusted by the video peaking compensation circuit 132. The compensation circuit 132 increases bandwidth to correct for smearing and blurring of the video output caused by the RC time constant of the cable 12 capacitance. As such, the compensation circuit 132 produces rectified video output signals 146 that are substantially similar to the composite video signals 94 generated by the camera 82.

The display driver 136 is operably connected to the compensation circuit 132 for receiving the rectified video output signals 146. The display driver 136 processes the composite video signals 148 to generate display signals 150 compatible with display 20.

The frame compare circuit 154 also is coupled to the rectified video output 146 of the compensation circuitry 132. Thus, the warning alarm 158 will be activated if a fish approaches the lure 52.

It will be readily apparent from the foregoing detailed description of the invention and from the illustrations thereof that numerous variations and modifications may be effected without departing from the true spirit and scope of the novel concepts or principles of this invention.

I claim:

1. A coupling system suitable for use with a downrigger cable comprising:

(a) a reel assembly having a base and a cable reel rotatably mounted to said base for winding said downrigger cable;

(b) a rotor attached to said reel assembly; and (c) an electrical pickup attached to said reel assembly for transmitting electrical signals between said pickup and said rotor.

2. The coupling system of claim 1, wherein said rotor has a plurality of concentric conductive rings mounted thereon.

3. The coupling system of claim 2, wherein said rotor is attached to said cable reel.

4. The coupling system of claim 2, wherein said electrical pickup has a plurality of brushes in communication with said conductive rings.

5. The coupling system of claim 4, wherein said electrical pickup is operably attached to said base.

6. The coupling system of claim 1, wherein said contact unit is operably coupled to said cable which includes a plurality of conductive leads twisted about each other, said conductive leads being electrically isolated from each other, and an outer shield spirally surrounding said conductive leads.

7. The coupling system of claim 6, wherein said outer shield includes about twelve strands of stainless steel, each having an outer diameter of about 0.01 inch.

8. The coupling system of claim 6, wherein said conductive leads comprise three strands of conductive wire.

9. The coupling system of claim 6, wherein said conductive leads are operably coupled to a camera assembly.

10. A coupling system for a reel assembly and a downrigger cable, said reel assembly having a base attached to a vessel and a reel rotatably mounted in relation to said base, said downrigger cable having a plurality of conductive leads electrically isolated from each other and an outer shield spirally surrounding said conductive leads comprising:

(a) a contact unit having a rotor with a plurality of concentric conductive rings mounted thereon, said contact unit operably connected to said base, said reel, and said conductive leads for transmission of said electrically isolated signals between said cable and said vessel; and (b) a connector operably connected to said contact unit for transmission of said electrical signals between said cable and said vessel as said cable is spirally wound onto said cable reel.

11. The coupling system of claim 10, wherein said rotor is attached to said reel.

12. The coupling system of claim 10, wherein said contact unit includes a pick-up means attached to said reel assembly and having a plurality of brushes in communication with said conductive rings.

13. The coupling system of claim 12, wherein said pick-up means is operably connected between said rotor and said connector.

14. The coupling system of claim 10, wherein said outer shield of said downrigger cable includes about twelve strands of stainless steel, each having an outer diameter of about 0.01 inch.

15. The coupling system of claim 14, wherein said conductive leads comprise three strands of conductive wire.

16. The coupling system of claim 10, wherein said conductive leads are operably coupled to a camera assembly.

* * * * *